US009741322B2

(12) United States Patent
Hutchinson, Sr.

(10) Patent No.: US 9,741,322 B2
(45) Date of Patent: Aug. 22, 2017

(54) CAPTURING DEVICE

(71) Applicant: Titus L. Hutchinson, Sr., Jacksonville, FL (US)

(72) Inventor: Titus L. Hutchinson, Sr., Jacksonville, FL (US)

( * ) Notice: Subject to any disclaimer, the term of this patent is extended or adjusted under 35 U.S.C. 154(b) by 306 days.

(21) Appl. No.: 14/295,420

(22) Filed: Jun. 4, 2014

(65) Prior Publication Data

US 2014/0360337 A1 Dec. 11, 2014

Related U.S. Application Data

(60) Provisional application No. 61/832,210, filed on Jun. 7, 2013.

(51) Int. Cl.
*G10D 9/00* (2006.01)
*G10D 7/10* (2006.01)

(52) U.S. Cl.
CPC ..... *G10D 9/00* (2013.01); *G10D 7/10* (2013.01)

(58) Field of Classification Search
CPC G10D 9/02; G10D 7/005; G10D 9/04; G10D 9/026; G10G 5/00
USPC ..... 84/385 R, 387 A, 397
See application file for complete search history.

(56) References Cited

U.S. PATENT DOCUMENTS 4,016,794 A * 4/1977 Brown ..... G10D 7/10 84/397

FOREIGN PATENT DOCUMENTS

JP 09101661 A * 4/1997 ..... G10D 3/00

* cited by examiner

*Primary Examiner* — Kimberly Lockett
(74) *Attorney, Agent, or Firm* — Lawrence J. Gibney, Jr.; Mitchell R. Ghaneie

(57) ABSTRACT

A capturing device joins with an instrument to capture an accumulated body fluid in the instrument. The device has a tubular shape for capturing and containing a superfluous amount of fluid that has accumulated inside an instrument from performing on the instrument. The device joins with the instrument, proximally to an instrument fluid accumulation portion. For example, the device is oriented on the instrument to capture the fluid that accumulates in the spit valve. The instrument may require tilting or other manipulations to enable fluid to flow from the instrument fluid accumulation portion to a reception aperture. The device is capped on each end, whereby one of the capped ends form a secure seal for trapping the body fluid inside the device, and may also be removed for removing the body fluid. The device has an absorbent portion to absorb the fluid in an interior region.

19 Claims, 5 Drawing Sheets

CAPTURING DEVICE

CROSS-REFERENCE TO RELATED APPLICATIONS

The present Utility patent application claims priority benefit of the [U.S. provisional application for patent Ser. No. 61/832,210 Liquid Trap, filed on Jun. 7, 2013 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to a capturing device. More particularly, the invention relates to a capturing device that joins with an instrument to capture an accumulated body fluid in the instrument.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that a musical instrument is a device created or adapted to make musical sounds.

Typically, a trombone is a musical instrument in the brass family. Like all brass instruments, sound is produced when the player's vibrating lips cause the air column inside the instrument to vibrate. Nearly all trombones have a telescoping slide mechanism that varies the length of the instrument to change the pitch.

In many instances, a large amount of saliva accumulates in a player's mouth while blowing into the trombone, or generally any brass or wind instrument. The saliva often accumulates at a spit valve inside the instrument. After a duration, the spit valve must be emptied. This requires stopping to play and orienting the instrument in a direction from which it cannot be played.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2A illustrates a side view, and FIG. 2B illustrates the capturing device rotating on an exemplary instrument arm;

Figure 1:
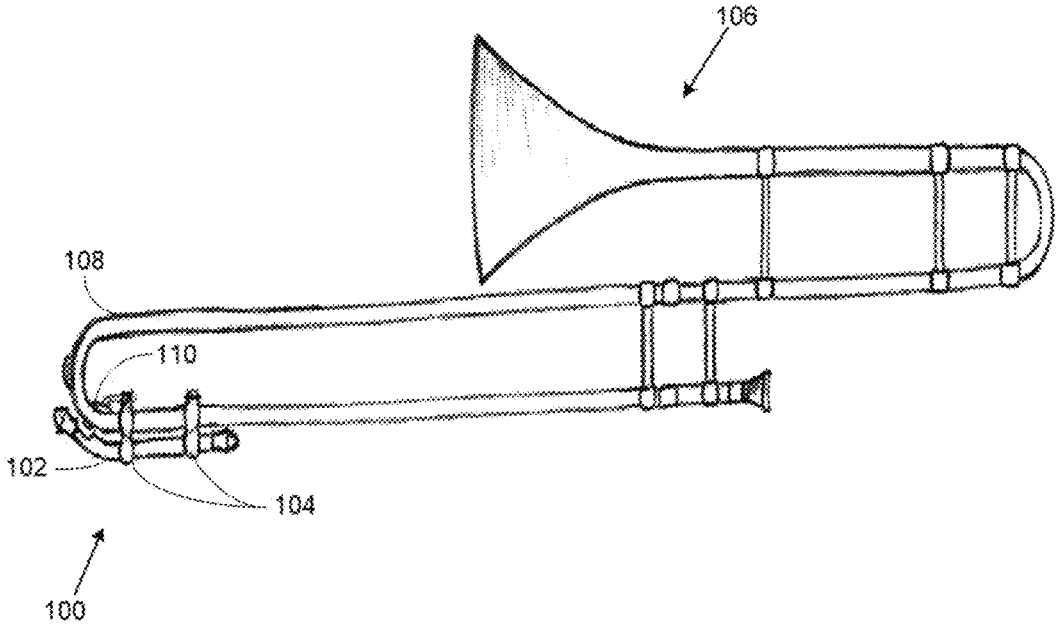
FIG. 1 illustrates an elevated side view of an exemplary capturing device joined with an exemplary instrument, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings.

There are various types of a capturing device that enhance the function of an instrument that may be provided by preferred embodiments of the present invention. In one embodiment of the present invention, the capturing device may join with an instrument to capture an accumulated body fluid in the instrument. In some embodiments, the capturing device may include a generally tubular shape configured to capture and contain a superfluous amount of body fluid that has accumulated inside an instrument from a user performing on the instrument. The device may be disposed to join with the instrument, proximally to an instrument fluid accumulation portion. The device may be oriented on the instrument to at least partially capture the body fluid that accumulates in the spit valve. In some embodiments, the instrument may require tilting or other minor manipulations to enable the fluid to flow from the instrument fluid accumulation portion to a reception aperture on the device. The device may be capped on each end, whereby one of the capped ends form a secure seal for trapping the body fluid inside the device, and may also be removed for removing the body fluid. The device may be configured to absorb and discharge the body fluid more efficiently than the fluid accumulation portion of the instrument alone.

Those skilled in the art will recognize that for an instrument, such as a wind or bass instrument, sound is produced when vibrating lips cause the air column inside the instrument to vibrate. Wind instruments generate sound by directing a focused stream of air across the edge of an opening or sharp edge. Many brass instruments have a telescoping slide mechanism that varies the length of the instrument to change the pitch of the sound. In either case, manipulation of the lips while producing the sound may generate copious quantities of a body fluid in the mouth. The superfluous body fluid often flows into the wind or brass instruments, accumulating at a designated instrument fluid receptacle portion, such as a spit valve.

FIG. 1 illustrates an elevated side view of an exemplary capturing device joined with an exemplary instrument, in accordance with an embodiment of the present invention. In the present invention, a capturing device 100 may include a body portion 102 having a generally tubular shape configured to capture and contain a superfluous amount of body fluid that has accumulated inside an instrument from a user performing on the instrument. The size and dimension of the body portion may be effective for capturing a fluid, such as a body fluid or saliva. The shapes may include, without limitation, an elongated tube, an elongated pyramid, a rectangle, and a cube. In one embodiment, the body portion is up to 45" long and has a diameter of up to 4". These dimensions are sufficient to contain a large amount of saliva accumulated during a session of playing music. However other dimensions may be utilized, largely depending on the type of instrument In some embodiments, an instrument fastener 104, such as a bracket and wing nuts may be utilized to join the device to an instrument arm 108. The device may be disposed to join with the instrument, proximally to an instrument fluid accumulation portion 110. The instrument fluid accumulation portion may be oriented on the instrument to receive the body fluid that accumulates in the instrument fluid accumulation portion. In some embodiments, the instrument may require tilting or other minor manipulations to enable the fluid to flow from the instrument fluid accumulation portion to an interior region of the device. In some embodiments, the device may be capped on each end, whereby one of the capped ends form a secure seal for trapping the body fluid inside the device, and may also be removed for removing the body fluid. The device may be configured to absorb and discharge the body fluid more efficiently than the fluid accumulation portion of the instrument alone. Suitable materials for the device may include, without limitation, aluminum, brass, copper, metal alloys, wood, a rigid polymer, and fiberglass.

Those skilled in the art will recognize that the instrument used with the device may include a brass instrument including, without limitation, a trombone, a tuba, a trumpet, a cornet, a euphonium. Often, sound may produced when vibrating lips cause the air column inside the instrument to vibrate. The brass instruments may include a telescoping instrument arm that varies the length of the instrument to change the pitch of the sound. Also keys may be used to manipulate the flow of air. In either case, manipulation of the lips while producing the sound may generate copious quantities of a body fluid in the mouth. The superfluous body fluid often flows into the instrument, accumulating at the instrument fluid receptacle portion, such as a spit valve.

Figure 2A:
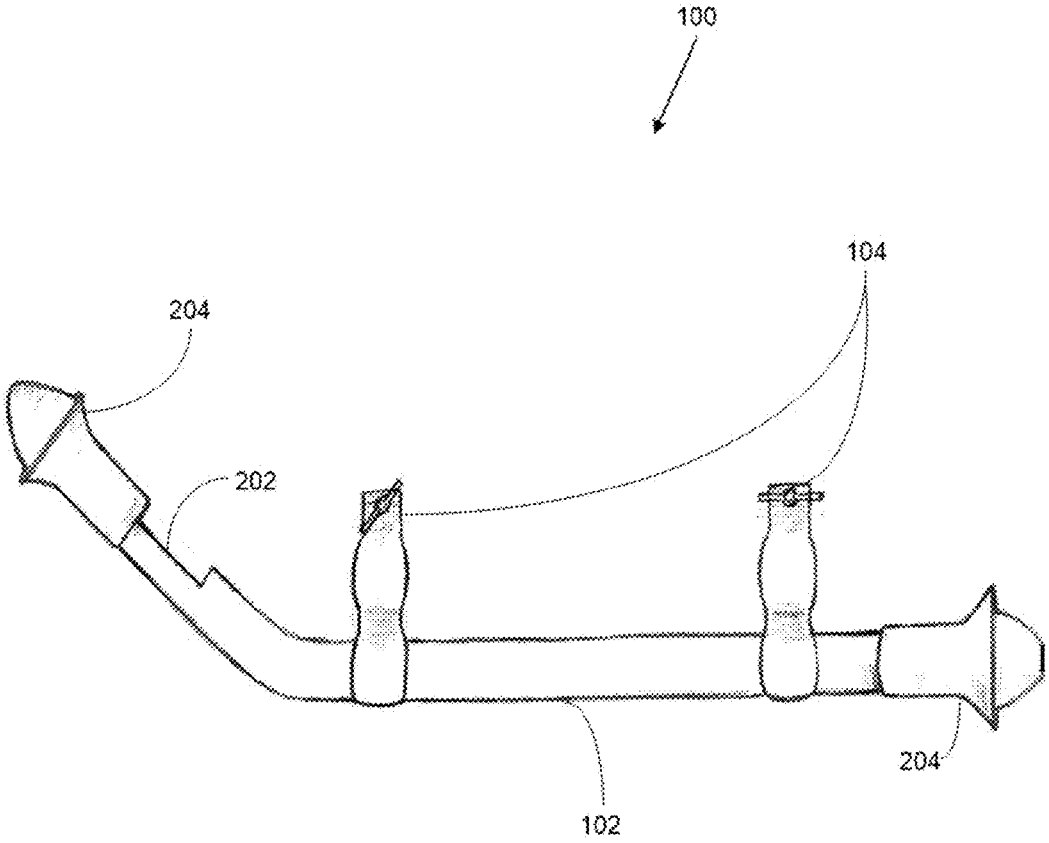
FIGS. 2A and 2B illustrate various views of an exemplary capturing device, where
Figure 2B:
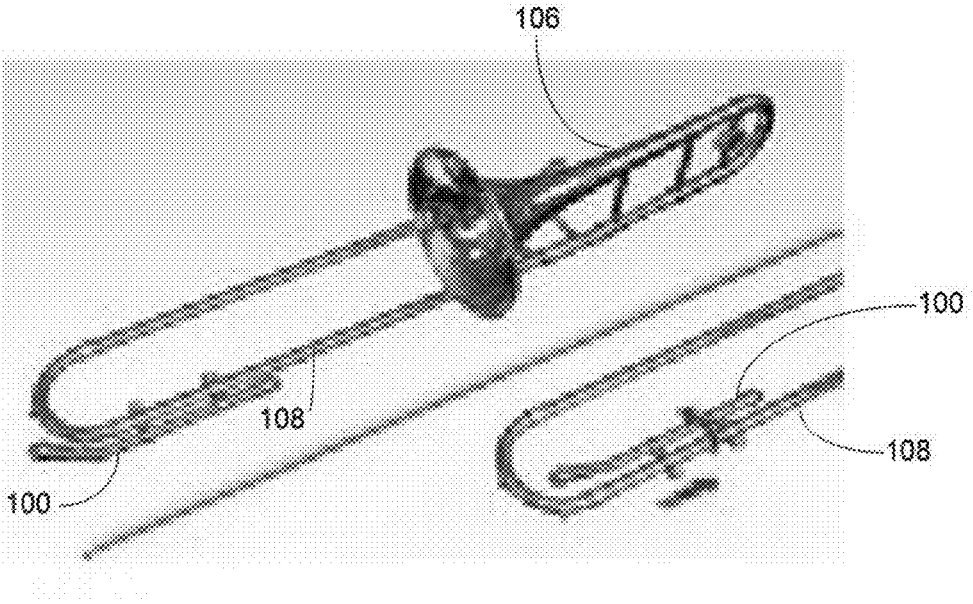

FIGS. 2A and 2B illustrate various views of an exemplary capturing device, where FIG. 2A illustrates a side view, and FIG. 2B illustrates the capturing device rotating on an exemplary instrument arm. In the present invention, the device is oriented to receive the fluid from the instrument fluid accumulation portion through a reception aperture 202. The reception aperture may be sized larger than a release nozzle on the instrument fluid accumulation portion, such that the body fluid does not spill out. The reception aperture may also position beneath the instrument fluid accumulation portion so that gravity helps force the body fluid into the reception aperture. The body portion may also attach to a telescoping arm on a trombone, directly beneath the instrument fluid accumulation portion. In one embodiment, the body portion may curve up to a nozzle that extends from the instrument fluid accumulation portion when in use In some embodiments, the body portion is capped on both ends by a pair of caps 204. The pair of caps mate with open ends on the body portion. The pair of caps can be removed and attached as desired. A cap fastener secures each cap to the open end of the body portion. The cap fastener may include, without limitation, a pair of adjustable straps, a hook and loop fastener, a frictional connection, a threaded end, a magnet, and an adhesive. In some embodiments, a pair of inside strips of metal may be covered by the hook and loop fastener to protect the instrument. The hook and loop fastener is generally soft enough to inhibit scratching or damage to the instrument during operation. In some embodiments, the device attaches generally to an instrument arm on a brass instrument. The instrument fastener secures the device to the instrument arm so that the device may be rotatable. In this manner, the device can better orient to capture and trap the body fluid from the instrument fluid accumulation portion. Also, while the instrument arm telescopically extends and retracts, the device may be moved out of the path.

Figure 3:
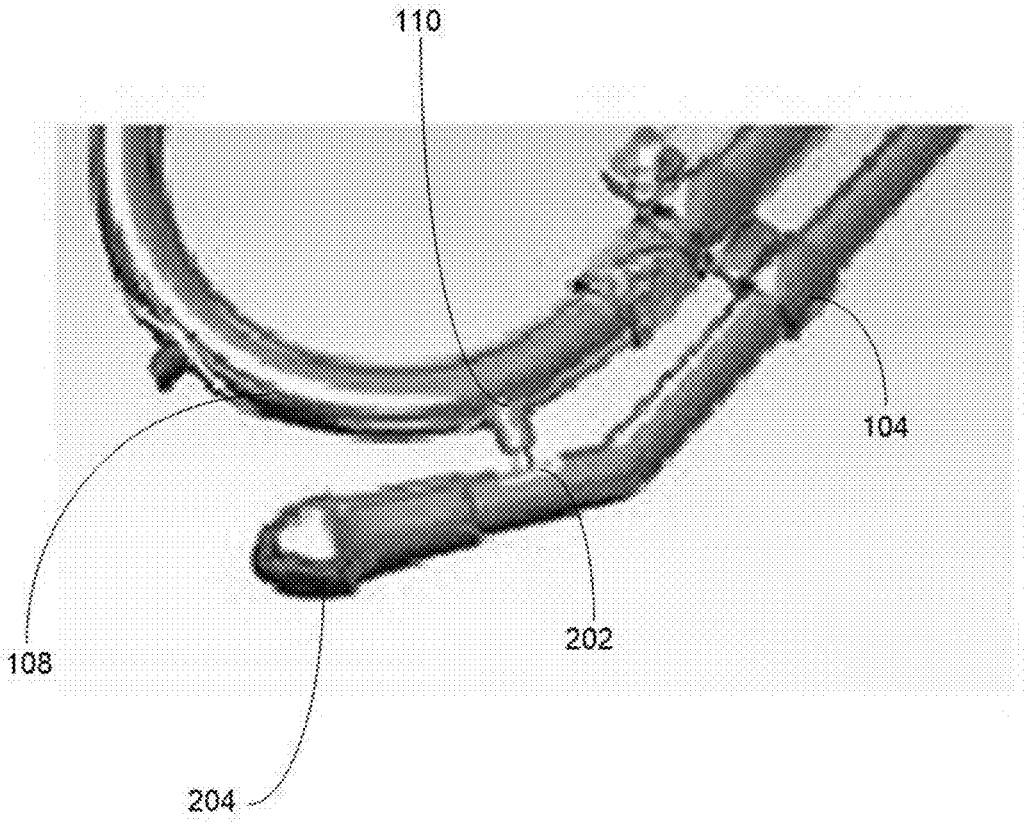
FIG. 3 illustrates a close up view of an exemplary instrument fluid accumulation portion oriented over an exemplary reception aperture on a capturing device.

FIG. 3 illustrates a close up view of an exemplary instrument fluid accumulation portion oriented over an exemplary reception aperture on a capturing device. In the present invention, the instrument fluid accumulation portion may be oriented on the instrument to receive the body fluid that accumulates in the spit valve. In some embodiments, the instrument may require tilting or other minor manipulations to enable the fluid to flow from the instrument fluid accumulation portion to an interior region of the device. In operation, when playing the instrument, an instrument player may remove either cap. The player may then hold the body portion up to the spit valve, and empty the valve into the body portion before finally replacing the cap. The body portion may curve up to the instrument fluid accumulation portion when in use and the inside strips are covered by hook and loop fastener to protect the instruments. Afterward, the players can clean out the interior region of the body portion for reuse as needed.

Figure 4:
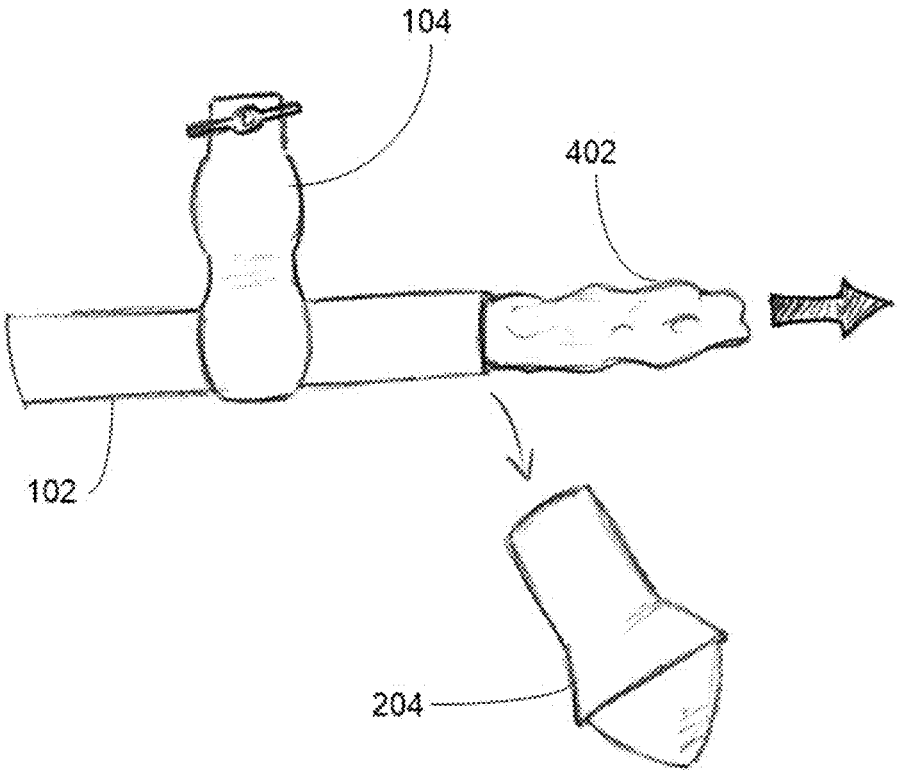
FIG. 4 illustrates a detailed perspective view of an exemplary cap removed from an exemplary capturing device for removing an exemplary absorbent portion.

FIG. 4 illustrates a detailed perspective view of an exemplary cap removed from an exemplary capturing device for removing an exemplary absorbent portion. In the present invention, the pair of caps may be removed to expose an interior region of the body portion. The body portion may include an absorbent member 402 configured to absorb the body fluid. The absorbent member helps minimize the amount of body fluid that accumulates in the body portion. The absorbent member may include, without limitation, cotton, paper, and insulated material. The absorbent member may be removed by detaching a cap. A dry absorbent member can then be replaced in the interior region.

In one alternative embodiment, the body portion may include a flow of air to help dry the body fluid inside the body portion. In another alternative embodiment, the tube portion is compartmentalized to capture different quantities of the body fluid. In yet another alternative embodiment, the pair of caps threadably engage the ends of the body portion.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings.

For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

It will be further apparent to those skilled in the art that at least a portion of the novel method steps and/or system components of the present invention may be practiced and/or located in location(s) possibly outside the jurisdiction of the United States of America (USA), whereby it will be accordingly readily recognized that at least a subset of the novel method steps and/or system components in the foregoing embodiments must be practiced within the jurisdiction of the USA for the benefit of an entity therein or to achieve an object of the present invention. Thus, some alternate embodiments of the present invention may be configured to comprise a smaller subset of the foregoing means for and/or steps described that the applications designer will selectively decide, depending upon the practical considerations of the particular implementation, to carry out and/or locate within the jurisdiction of the USA. For example, any of the foregoing described method steps and/or system components which may be performed remotely over a network (e.g., without limitation, a remotely located server) may be performed and/or located outside of the jurisdiction of the USA while the remaining method steps and/or system components (e.g., without limitation, a locally located client) of the forgoing embodiments are typically required to be located/performed in the USA for practical considerations. In client-server architectures, a remotely located server typically generates and transmits required information to a US based client, for use according to the teachings of the present invention. Depending upon the needs of the particular application, it will be readily apparent to those skilled in the art, in light of the teachings of the present invention, which aspects of the present invention can or should be located locally and which can or should be located remotely. Thus, for any claims construction of the following claim limitations that are construed under 35 USC §112 (6) it is intended that the corresponding means for and/or steps for carrying out the claimed function are the ones that are locally implemented within the jurisdiction of the USA, while the remaining aspect(s) performed or located remotely outside the USA are not intended to be construed under 35 USC §112 (6).

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing a body fluid capturing mechanism on a brass instrument according to the present invention will be apparent to those skilled in the art. Various aspects of the invention have been described above by way of illustration, and the specific embodiments disclosed are not intended to limit the invention to the particular forms disclosed. The particular implementation of the body fluid capturing mechanism on a brass instrument may vary depending upon the particular context or application. By way of example, and not limitation, the body fluid capturing mechanism on a brass instrument described in the foregoing were principally directed to a tube that positions proximal to a spit valve on a trombone to receive and trap the saliva therein implementations; however, similar techniques may instead be applied to capturing fluids from any instrument or tool where human breath is used, and saliva may accumulate, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A device comprising:

a tube portion configured to capture a fluid accumulated in an instrument, said tube portion disposed to join with said instrument, said tube portion comprising a body portion, in which said body portion comprising;

a reception aperture, wherein said reception aperture configured to at least partially receive said fluid from an instrument fluid accumulation portion;

an open end segment, in which said open end portion comprising at least a pair of open end segments operable for expelling said fluid out of said tube portion; and a cap implement, in which said cap implement comprises at least pair of two or more cap implements, wherein each of said cap implements being disposed on each of said pair of open end segments configured to regulate access to said fluid; and a fastener tool, in which said fastener tool is a tube portion fastening implement comprising at least one or more bracket implements configured to join said tube portion to said fluid accumulation portion of said instrument.

2. The device of claim 1, in which said instrument is a brass instrument comprising at least one of, a trombone, a tuba, a trumpet, a comet, and a euphonium.

3. The device of claim 2, wherein said fluid accumulates from operating said instrument.

4. The device of claim 3, wherein gravity generally forces said fluid from said instrument fluid accumulation portion towards said reception aperture.

5. The device of claim 4, wherein said instrument fluid accumulation portion is less than approximately 2" from said reception aperture.

6. The device of claim 2, wherein said tube portion joins with an arm of said instrument, and in which said body portion further comprising a cap implement fastener, in which said cap implement fastener comprises at least two or more cap implement fasteners, wherein said cap implement fastener is configured to secure each of said cap implements to each of said open end segments.

7. The device of claim 6, wherein said fastener tool further comprising at least one or more wing nuts configured to fastens—said tube portion to said instrument arm.

8. The device of claim 1, in which said fastener tool further comprises at least one or more wing nut implements configured to fasten said tube portion to said instrument arm.

9. The device of claim 8, in which said tube portion comprises a material including, at least one of, an aluminum, a brass, a copper, a metal alloy, a wood, a rigid polymer, and a fiberglass.

10. The device of claim 1, wherein said body portion comprising a length of approximately 45" and a diameter of approximately 4".

11. The device of claim 10, in which said tube portion comprises an interior region configured to hold said fluid.

12. The device of claim 11, wherein said fluid accumulation portion comprises a spit valve of said instrument.

13. The device of claim 12, wherein an absorbent portion is configured to positions in said interior region.

14. The device of claim 13, in which said absorbent portion comprises at least a cotton absorbent material.

15. The device of claim 14, wherein each cap is further configured to detach from each end of said body portion for discarding said fluid and said absorbent portion.

16. The device of claim 15, wherein said device comprises at least an aluminum material.

17. The device of claim 16, wherein each cap implement fastener forms a seal to at least partially inhibit said fluid from leaking from said tube portion.

18. The device of claim 17, in which said instrument comprises a brass instrument including, at least one of, a trombone, a tuba, a trumpet, a comet, and a euphonium.

19. A device comprising of:

a tube portion configured to capture and retain a fluid from an instrument, said fluid comprising saliva, said tube portion disposed to join with said instrument, said instrument comprising at least a brass instrument, said tube portion comprising a body portion, said body portion comprising a reception aperture configured to at least partially receive said fluid that has accumulated in an instrument fluid accumulation portion, said tube portion further comprising an interior region configured to store said fluid, said tube portion further comprising a pair of open end segments, said pair of open end segments comprising a pair of cap implements configured to regulate access to said fluid;

an absorbent portion dispose inside said interior region, said absorbent portion configured to at least partially absorb said fluid captured in said interior region, said absorbent portion comprising cotton; and a fastener tool, in which said fastener tool is a tube portion fastening implement comprising at least one or more bracket implements configured to join said tube portion to said fluid accumulation portion of said instrument.

* * * * *